US006974125B2

(12) United States Patent
Renton

(10) Patent No.: US 6,974,125 B2
(45) Date of Patent: Dec. 13, 2005

(54) PULLEY BLOCK

(75) Inventor: Julian Renton, Bradford-on-Avon (GB)

(73) Assignee: Lewmar Limited, Hampshire (GB)

( * ) Notice: Subject to any disclaimer, the term of this patent is extended or adjusted under 35 U.S.C. 154(b) by 69 days.

(21) Appl. No.: 10/482,996

(22) PCT Filed: Jul. 16, 2002

(86) PCT No.: PCT/GB02/03261

§ 371 (c)(1),
(2), (4) Date: Jan. 8, 2004

(87) PCT Pub. No.: WO03/008264

PCT Pub. Date: Jan. 30, 2003

(65) Prior Publication Data

US 2004/0195554 A1 Oct. 7, 2004

(30) Foreign Application Priority Data

Jul. 20, 2001 (GB) ..... 0117749

(51) Int. Cl.[7] ..... B66D 3/04

(52) U.S. Cl. ..... 254/409; 254/415

(58) Field of Search ..... 254/409, 410, 254/411, 413, 415

(56) References Cited

U.S. PATENT DOCUMENTS

| | | | | | |
|---|---|---|---|---|---|
| 691,492 | A | * | 1/1902 | Roney | 254/409 |
| 2,291,894 | A | * | 8/1942 | Gwinn, Jr. | 254/415 |
| 2,453,357 | A | * | 11/1948 | Barkley | 114/111 |
| 3,526,389 | A | * | 9/1970 | Horgan, Jr. | 254/409 |
| 3,528,645 | A | * | 9/1970 | Harken | 254/412 |
| 3,705,708 | A | * | 12/1972 | Cunningham | 254/409 |
| 3,773,295 | A | | 11/1973 | Holmes | |
| 3,806,094 | A | | 4/1974 | Harken | |
| 3,899,158 | A | * | 8/1975 | Johnson | 254/405 |
| 5,984,278 | A | | 11/1999 | Hartlmeier | |

FOREIGN PATENT DOCUMENTS

| | | |
|---|---|---|
| GB | 811599 | 4/1959 |

* cited by examiner

*Primary Examiner*—Emmanuel M Marcelo
(74) *Attorney, Agent, or Firm*—Burns, Doane, Swecker & Mathis, L.L.P.

(57) ABSTRACT

A line-handling block particularly for sailing vessels has an attachment device (30) rotatably mounted in the body. Locking device (50) are slidable in keyhole slots (60) into or out of engagement with the attachment device (30). When in engagement the locking device (50) may permit only limited rotation of the attachment device to either side of a central position. They may yield if an excessive torsional load is experienced, and may be supplied in various interchangeable forms for fitting to a given block so that its characteristics may be adjusted.

18 Claims, 7 Drawing Sheets

PULLEY BLOCK

The present invention relates to a block of the kind used in line-handling. It is particularly, but not exclusively related to a block for handling, guiding, turning or deflecting a line, rope, cable or wire as typically used on sailing craft. We will refer to each of these as a "line".

Line-handling blocks typically comprise a rotatable sheave sandwiched between two cheek portions. The cheek portions restrain the line to run in the plane of rotation of the sheave. These blocks allow the direction taken by a line to be controlled, for example, between a securing point or a winch and a load. They also allow the friction on such a line to be reduced compared to alternative guiding means such as an eye because if the movement of the line through the block causes a frictional contact with the sheave, then the sheave will rotate at the same tangential speed as the line passes through the block.

Thus the friction encountered if the line is running true is reduced. The main contributors to the remaining losses are the friction associated with the rotation of the sheave itself, which can be reduced by using, for example, rolling contact bearings, and the losses incurred between input and output loads due to the bending of the line around a relatively small arc.

Most blocks usually also have a rotatable swivel pin which allows attachment of the block to some external body. The swivel pin allows the whole block to rotate about an axis perpendicular to the axis of rotation of the sheave, and thereby allows the block to move to adjust to, for example, the movement of the load on one end of the line. If the attachment of the swivel pin to the external body is also pivoted about a third axis of rotation, then the block can accommodate many different directions of the line, subject to the constraints imposed by the presence of the external body itself.

In some cases it is advantageous to be able to lock the swivel pin relative to the block, for instance when a line emerging from a block is intended to only be pulled in one direction. Normally two modes of operation are possible: a) free rotation of the block as described above; b) locked in one of two positions separated by 90°.

One current method for accomplishing this locking is by means of a locking pin which is inserted through the body of the block and through the swivel pin, the engagement of the locking pin with the body of the block in each fixed position preventing the swivel pin from rotating. The pin is then removed for free rotating operation. This arrangement is found in the SOLENT range of blocks manufactured by the applicant. Alternatively a setting screw may be used to hold the swivel pin in a selected locked position.

One advantage of locking the swivel pin is that it prevents the block rotating when there is no load on the line, resulting in a twisted line when load is subsequently placed on the line.

However, the arrangements for locking the swivel pin described above do not allow any freedom of movement either side of the locked position, for example when the pulling direction may vary through a narrow angular range, such as from one side of a winch to the other or to follow the movement of a sail, or when the block system is not correctly aligned when it is set up in the overall arrangement of the line(s). Fixing the movement of the swivel pin in these situations can, over time, lead to damage to the block, to the installation anchors or to the body to which it is attached, due to twist loading. Fixing the movement in this way can also increase the rolling friction of the block as the sheave may be twisted into contact with the cheeks of the block.

Another disadvantage of conventional locking systems as described above is that a sudden change in the direction of the loading can cause serious damage to the block and possibly even rip it from its anchor, which in a high load situation could also cause damage to other parts of the system.

Therefore, according to a first aspect of the present invention, there is provided a line-handling block with a body comprising first and second cheeks, the cheeks rotatably bearing a sheave for rotation about an axis; attachment means for attaching the block to a securing point or the like being rotatably borne by said body; and at least one locking means engagable with the attachment means, which when engaged permits rotation of said attachment means relative to the cheeks and sheave only between predetermined limits.

Preferably the maximum rotation of the attachment means allowed either side of a central position, i.e. the predetermined limits of rotation, will lie in the range of 2 degrees to 90 degrees either side of the central position.

In some embodiments of this aspect of the invention, the maximum allowed rotation may be 5 degrees or more either side of the central position. In other embodiments, the maximum allowed rotation may be 45 degrees or less either side of the central position. In further embodiments, the maximum allowed rotation may be 10 degrees or more either side of the central position. In still further embodiments, the maximum allowed rotation may be 30 degrees or less either side of the central position.

Such a block allows some angular movement either side of the locked position, even when the locking means are engaged, and so it can accommodate some misalignment or variation in the direction of the line without damaging the block or reducing its efficiency.

It is possible that different limits of rotation to be imposed on the attachment means by the locking means can be selected, for example by engaging or disengaging different ones of a plurality of locking means.

According to a second aspect of the present invention there is provided a line-handling block with a body comprising first and second cheeks, the cheeks rotatably bearing a sheave for rotation about an axis; attachment means rotatably secured to said body; and at least one locking means engagable with the attachment means, which when engaged either prevents the rotation of said attachment means relative to the cheeks and sheave, or only permits such rotation between predetermined limits, and which is adapted so as to disengage or to fail when a predetermined torsion load is exceeded, thereby allowing free rotation of said attachment means.

Preferably the predetermined torsion load is less than a load at which damage would be suffered e.g. by the block or the body to which it is attached if the attachment means were to remain rotationally locked.

More preferably the predetermined torsion load is not more than 10 Nm (88 lb in) for the entire block.

In a variation of the second aspect of the present invention, the predetermined load at which the locking means fails or disengages is adjustable. For example, engaging extra locking means may increase the torsion load required before there is disengagement or failure, and disengaging one or more of the locking means could analogously reduce the torsion load required.

In a development of the above aspects of the invention, preferably the axes of rotation of the sheave and of the swivel attachment means are orthogonal and coplanar. Independently, the locking means may be separately formed from the other components of the block and be removable therefrom.

This separate nature of the locking means allows for their easy exchange or replacement in the block. This has several possible applications. For example, the block may be initially supplied with only one or two locking means, but have a capacity for four or more. Additional locking means can be provided and inserted if the user wishes to increase the disengagement or failure load referred to the in second aspect above. Alternatively, locking means may be produced which allow a range of different angular variations according to the first aspect above. These can then be interchanged in the block depending on the degree of directional rigidity needed in the block. In an application such as on a sailing vessel, these factors may be determined by the expected weather conditions, and using the right locking means for the conditions may result in better performance. In another alternative, if the locking means are designed to fail according to the second aspect above, then the ease and the low cost of replacement of separate locking means rather than of the entire block is important.

According to a third aspect of the present invention, there is provided a line-handling block with a body comprising first and second cheeks, the cheeks rotatably bearing a sheave for rotation about an axis; attachment means rotatably secured to said block; and at least one locking means engagable with the swivel attachment means, which when engaged restricts the rotation of said attachment means, the or each locking means being slidably engaged in the body and movable from a first position, engaged in said body, in which it is engaged with the attachment means to a second position, also engaged in said body, in which it is disengaged from the attachment means.

The engagement of locking means with the body may take the form of a keyhole slot in which the locking means slides between the first position and the second position. There may also be a third position in which the locking means can be removed from the body according to the development described above.

Having a simple mechanism by which the block can be switched from free swivel to restricted swivel and back, without the need for extra equipment or to disassemble the block, allows this interchange to be made more easily in harsh conditions, or more quickly in situations where time is important. It also means that changes to the restriction conditions of the attachment means according to the first and second aspects above (angular restriction and disengagement/failure load) can also be effected quickly and easily.

Preferably, the minimum diameter of the sheave at a point which contacts the line may be at least 5 times and not more than 8 times the diameter of the line.

Preferably the ratio of the minimum diameter of the sheave at a point which contacts the line to the diameter of the line is at least 5 and not more than 7, and more preferably, this ratio is about 6.

By adopting this ratio of the sheave diameter to the line diameter (or alternatively the ratio of radii), the losses between input and output loads due to the bending of the line around the sheave are optimally minimized. As a consequence, each particular block (having a particular sheave diameter) is optimised for a particular line size.

Two or more of the aspects and the developments thereof described above may be combined in a block according to the present invention.

The use of the term line-handling block in this application includes all devices having similar functions, such as a pulley-block, a foot block or a turning block.

The present invention also provides for a waterborne craft, such as a sailing vessel, having a block according to one or more of the aspects and the developments thereof described above.

Embodiments of the present invention will now be described in detail with reference to the accompanying drawings, in which.

Figure 1:
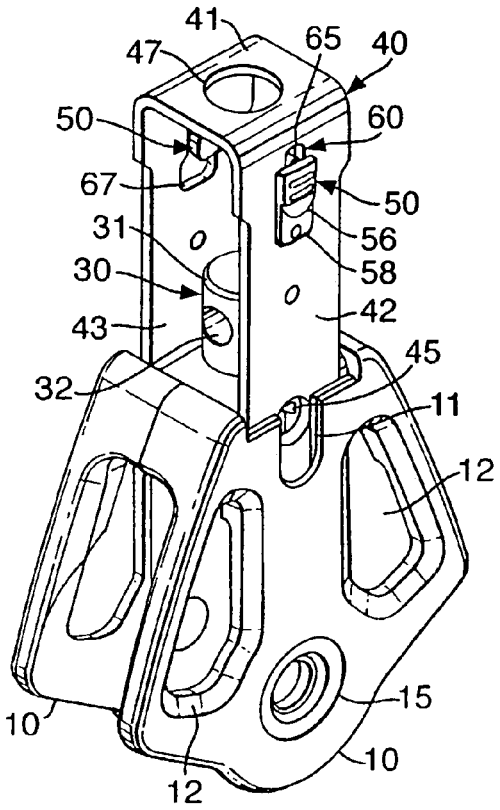
FIG. 1 shows a disassembled block embodying some of the aspects of the present invention.
Figure 2:
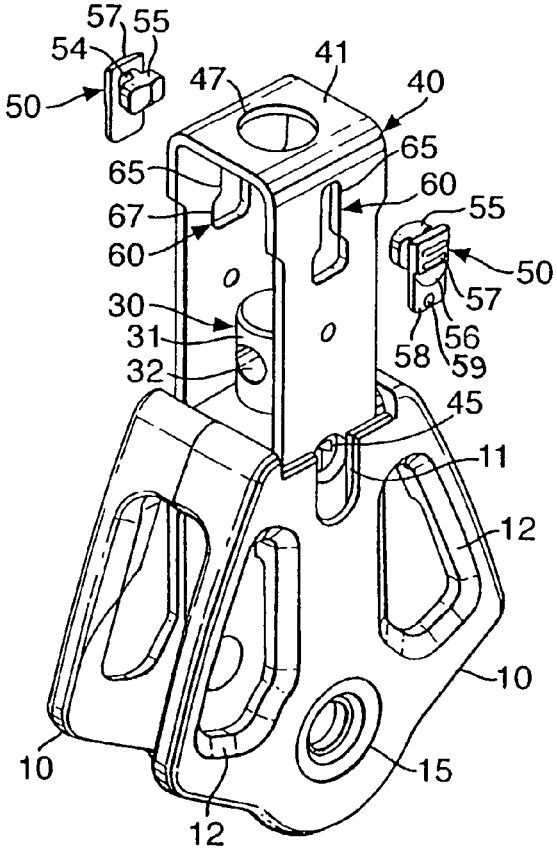
FIG. 2 shows the block of FIG. 1 with locking means removed.
Figure 4A:
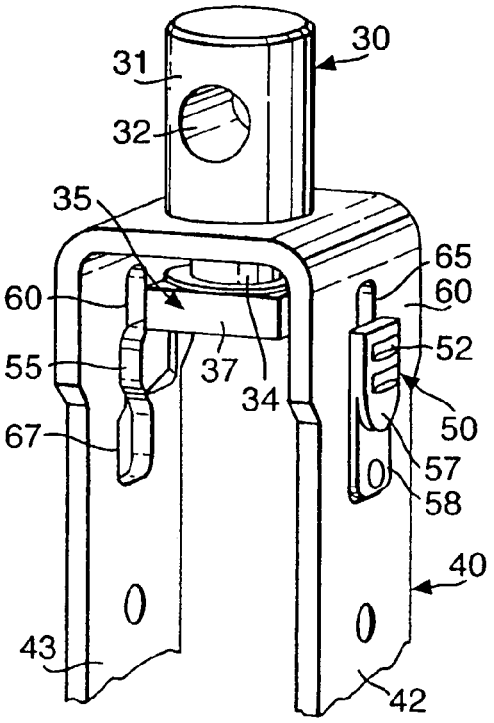
Figure 4B:
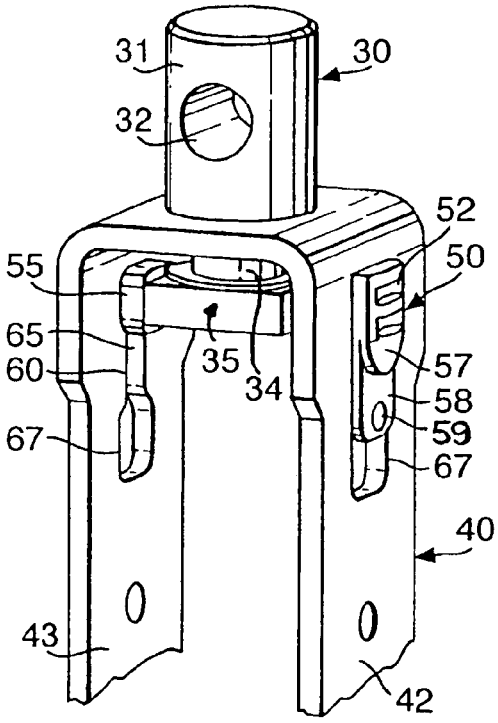
Figure 5A:
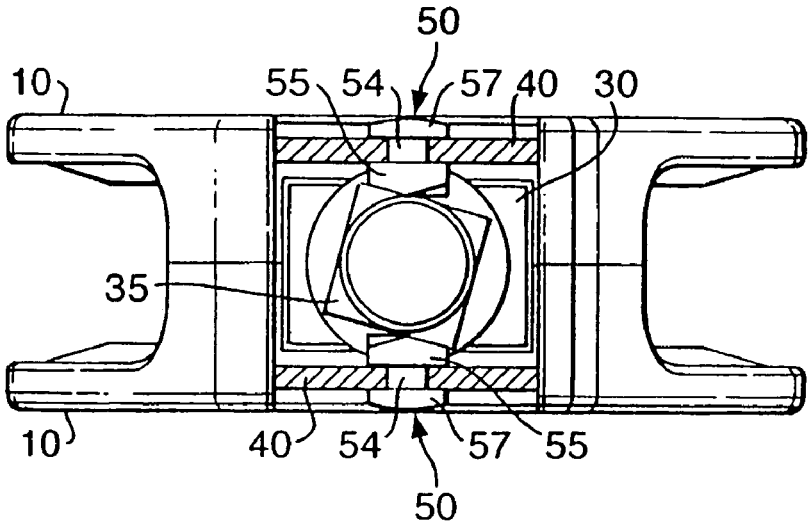
Figure 5B:
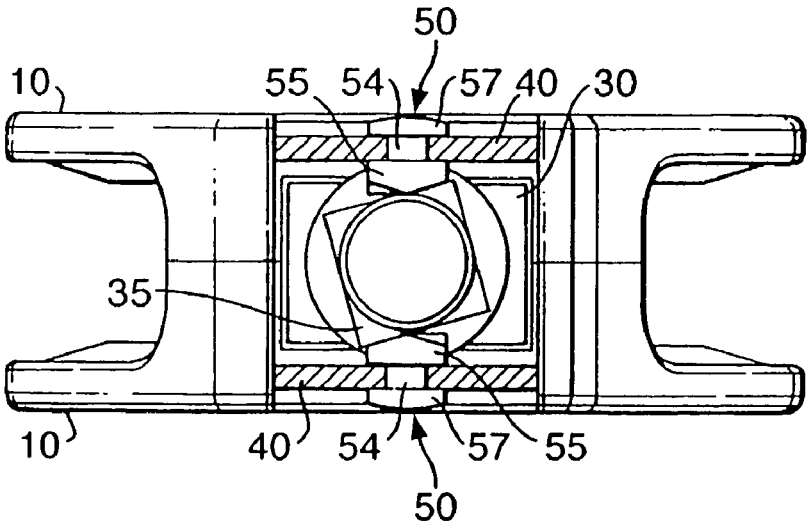
Figure 6:
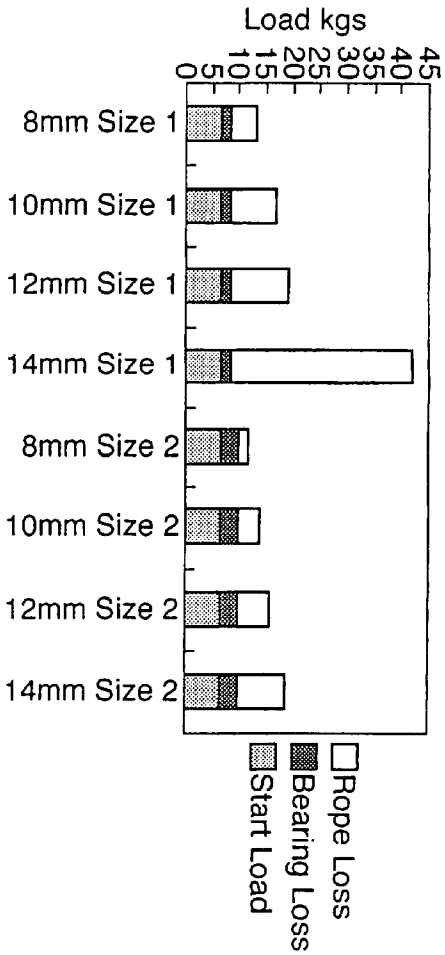
Figure 7:
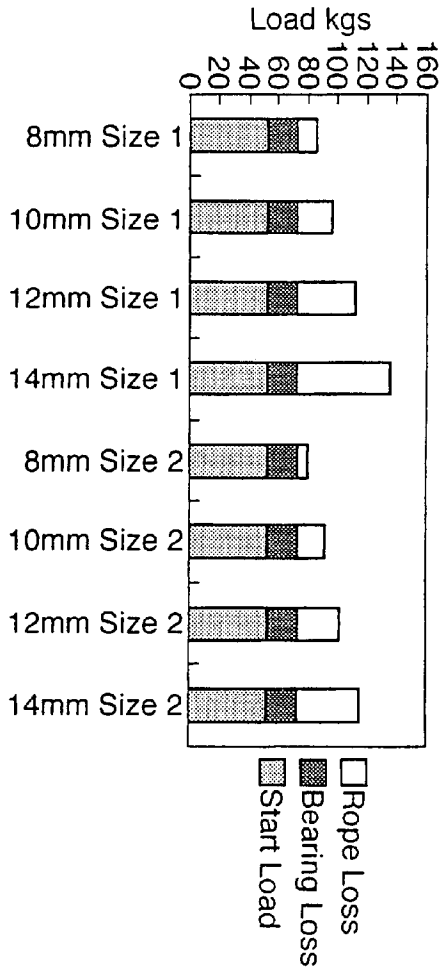
Figure 8:
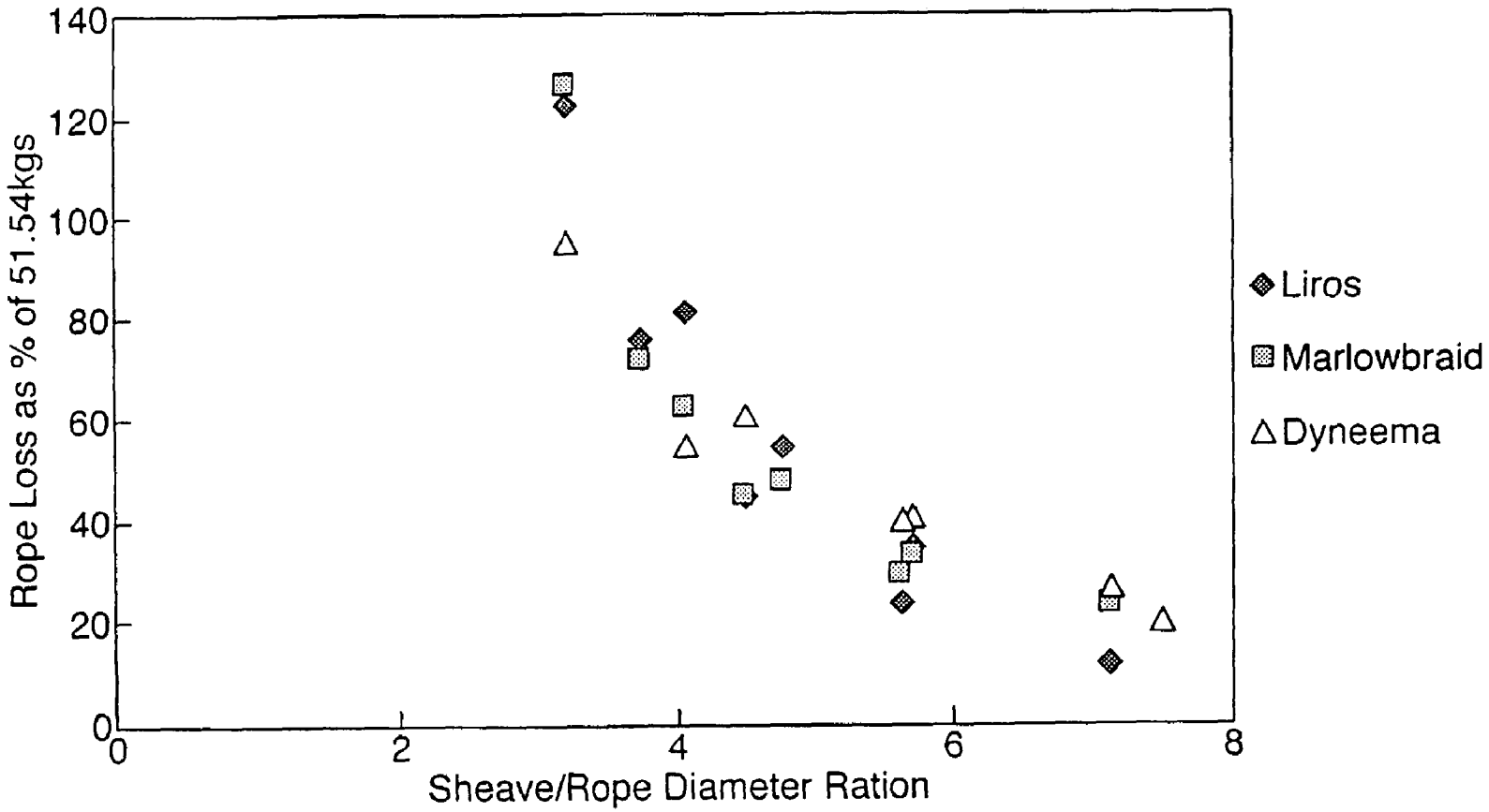

FIGS. 3*a*–3*d* show stages in the assembly of the block of FIGS. 1 and 2;

FIG. 4*a* shows the swivel attachment means arrangement in more detail with the locking means disengaged;

FIG. 4*b* shows the same arrangement as FIG. 4*a* but with the locking means engaged;

FIG. 5*a* is a sectional view of a block embodying some of the aspects of the present invention, with the swivel head at one extremity of its locked rotation;

FIG. 5*b* is the sectional view of FIG. 5*a* with the swivel head at the opposite extremity of its locked rotation;

FIG. 6 is a bar chart showing the break-down of the loads on a line for different line and sheave diameters at an initial load of 6.54 kg;

FIG. 7 is a bar chart showing the break-down of the loads on a line for different line and sheave diameters at an initial load of 51.54 kg; and FIG. 8 is a graph showing how the losses due to the bending of the line are affected by changing the sheave/line diameter ratio.

The block shown in perspective view in FIG. 1 is partially disassembled. It comprises two cheeks 10, a sheave (70 in FIGS. 3*c* and 3*d*), a strop 40, swivel attachment means 30 and locking means 50 engaged in the strop 40.

The cheeks 10 each have a recess 11 and an aperture 15 and a number of cut-away portions 12 which reduce the overall weight of the block. The generally U-shaped strop 40 has an end (base) portion 41, arms 42 and 43, apertures 45 in each arm 42,43 and an aperture 47 in the end portion 41. The swivel attachment means 30 has an body portion 31, with an aperture 32, through which the block may be attached to an external body, and a swivel head 35 (shown in FIGS. 4*a* and 4*b*) which has a number of faces 37. Slots 60 are formed in the arm portions 42 of the strop 40 and have a "keyhole" shape with a narrow portion 65 and a wider end portion 67.

Each locking means 50 has a bevelled head section 55, an outer section 57 and a neck section 54. The neck section is sufficiently narrow to move freely along the narrow portion 65 of slot 60, whilst the head section 55 can pass through the wider end portion 67 of slot 60. The outer section is provided with a number of ridges 52 and has a curved end 56 conforming to the shape of recess 11 in cheek 10. The ridges 52 provide purchase for the user to move the locking means 50 along slot 60. A slide part 58 of the locking means lies outside the strop 40 and has a part-spherical raised pip 59.

Figure 3A:
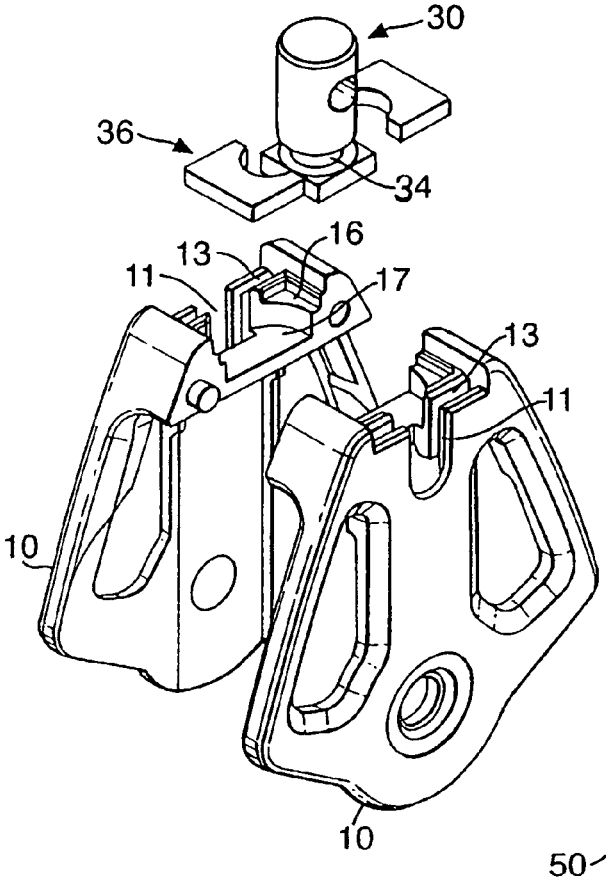
Figure 3B:
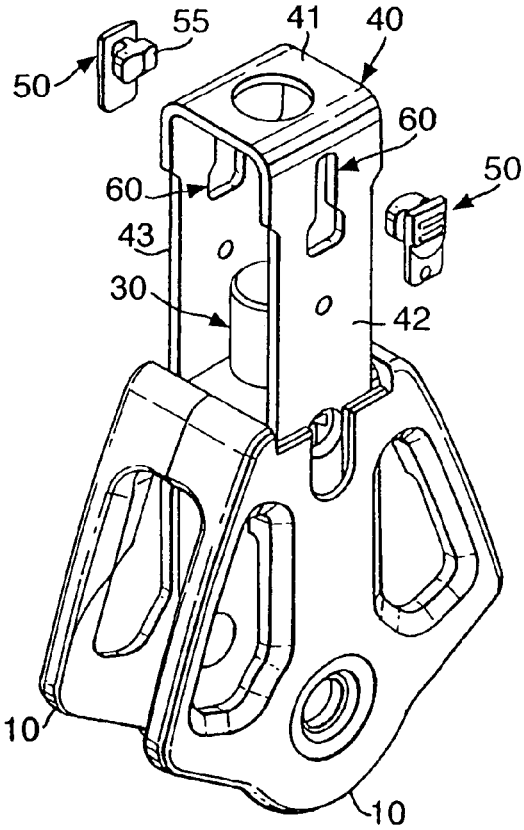
Figure 3D:
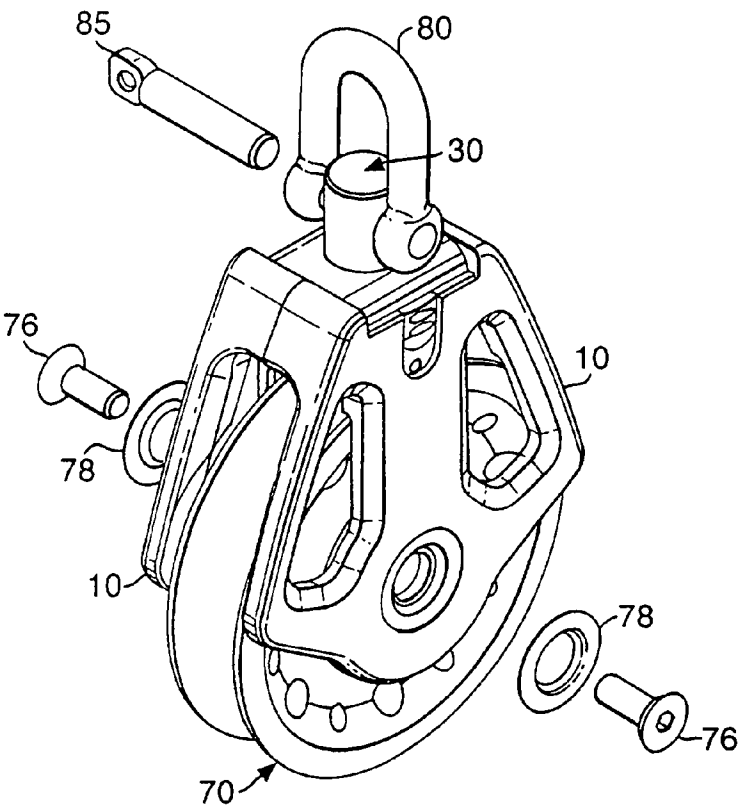
Figure 3C:
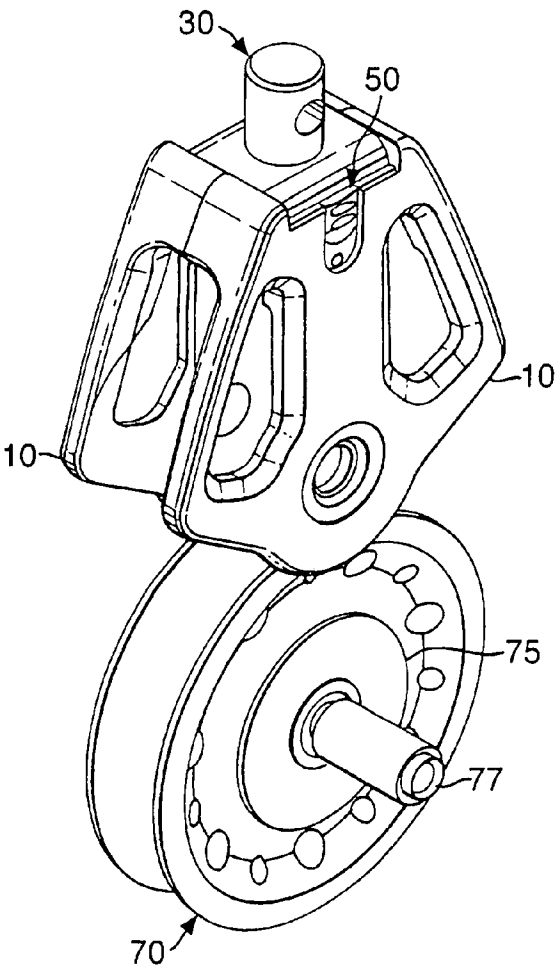

To assemble the block, strop 40 complete with locking means is slid into slots (13 in FIG. 3*a*) in the two cheeks 10 until an axle may be passed through apertures 15 and 45 and through an inner race of rolling contact bearings around the axis of rotation at the centre of the sheave (70 in FIGS. 3*c* and 3*d*). In the embodiment shown in FIG. 3*d*, this axle is bearing pin 77, which is held between the cheeks 10 by screws 76. This construction acts together with the slots 13 through which the strop arms are passed to secure the two cheeks 10 together so that no further attachment means (e.g. screws) are required to secure them. At the same time, the body portion 31 of swivel attachment means 30 passes through strop aperture 47. Once the block is assembled, the swivel head 35 may be restrained in rotation by one or both locking means 50.

The construction of slots 60 and the recess 11 in cheeks 10 means that when the block is assembled, the locking means 50 are constrained to move within the narrow portion 65 of slots 60 between a first position (as shown in FIG. 4*b*) in which they are engaged with the swivel head (35 in FIG. 4*b*) of swivel attachment means 30 and a second position (as shown in FIG. 4*a*) in which they are disengaged from the swivel head 35 of swivel attachment means 30, but because of abutment of ends 56 with the curved ends of recesses 11 cannot be removed or fall out of slots 60 since they cannot move to a third position in which the head section 55 of the locking means could pass through the end portion 67 of slots 60.

Also when the block is assembled interaction of the pips 59 with an inner face of the slots 13 in the cheeks hinders unwanted movement of the means 50, by engagement with an indented detent in the cheeks or by plain friction. Further, in the aspect of the invention concerned with yield of the locking means under excessive load, such load may be adjustable for a given locking means by provision of a series of detents producing a variable degree of engagement between the head 35 and the locking means.

To replace the locking means 50, the block is disassembled to the state shown in FIG. 1 (or FIG. 3*b*). The locking means 50 are then moved to the third position and removed from slots 60 by passing the head section 55 of each locking means through the end portion 67 of the slots. New locking means can then be inserted in the reverse manner, either to replace failed or damaged locking means, or to adjust the configuration of the locking means (e.g. limits of locked rotation or failure/disengagement load).

FIG. 2 shows the block of FIG. 1, but with the locking means 50 removed from slots 60.

FIGS. 3*a*–3*d* show stages in the construction of the block of FIGS. 1 and 2. In FIG. 3*a*, the two cheeks 10 are to be fitted together and securely hold a collet 36, through which the swivel attachment means 30 is rotatably mounted by engagement with its cylindrical neck 34.

In FIG. 3*b*, the cheeks 10 have been fitted together and now the strop 40 is to be slid into slots (13 in FIG. 3*a*) in the cheeks 10. Locking means 50 are engaged in keyhole slots 60 in either or both of arms 42, 43 of strop 40. The end 41 of the strop entraps the collet parts on a shelf 16 in the cheeks, with the head 35 of the attachment means in a cylindrical cavity 17 between them.

FIG. 3*c* shows one of the locking means 50 retained in recess 11 of cheek 10, and now sheave 70, containing bearing 75 and to be mounted on bearing pin 77 is about to be inserted between cheeks 10.

Finally, in FIG. 3*d*, the sheave 70 is secured between the cheeks 10 by screws 76 which engage with bearing pin 77 (not visible) through washers 78. In addition, shackle 80 is attached to the swivel attachment means 30 using shackle pin 85 penetrating aperture 32.

FIG. 4*a* shows the arrangement of the swivel head 35 of the swivel attachment means 30 and the locking means 50 in more detail, with the cheeks 10 and a collet 36 removed. The locking means 50 are both shown in a second position within the narrow portion 65 of slots 60, in which they are disengaged from the swivel head 35. When all the locking means 50 are in this second position, the swivel attachment means can rotate freely relative to the body of the block. The head section 55 of the locking means 50 lowermost in the Figure is also visible, showing its bevelled construction which allows some rotation of the swivel between predetermined limits. The degree to which the head section 55 is bevelled determines the angles between which the swivel head 35 can rotate freely, e.g. 2°, 5°, 10° or more, each side of a central position when the locking means 50 are engaged. Swivel head 35 has a square cross-section, having four faces 37, which allows the block to be locked in either of two alignments at 90° to each other. Swivel heads can be used which have more faces 37, thereby allowing locking in more than two locked central positions.

FIG. 4*b* shows the same arrangement as in FIG. 4*a*, but with the locking means 50 in a first position within the narrow portion 65 of the slots 60, in which they are engageable with the faces 37 of the swivel head 35, and thereby limiting the rotation of the swivel head 35 to that permitted by the bevelling of head sections 55.

When one or both locking means 50 are in the first position, and the body of the block (i.e. the cheeks 10, strop 40 and the sheave 70) is subjected to a torsion load in excess of a predetermined amount, even once the swivel head has rotated to the limit permitted by the locking means 50, the locking means 50 may be designed such that they either are forced back to the second, disengaged position, or they "pop-out" of the slots 60, or the head section 55 of the locking means 50 shears off, in each case allowing free rotation of the swivel head 55 relative to the body of the block.

If the two locking means 50 are of similar construction in terms of the angle of their bevelling and the loads at which they are designed to either disengage or fail, then they will share the load approximately equally and the maximum torsion load that can be applied to the body of the block before this failure or disengagement occurs can thus be adjusted by choosing the number of locking means 50 which are engaged at any one time. As far as this aspect of the invention is concerned the locking means need not be bevelled, so that when engaged they completely prevent rotation.

In one embodiment, the locking means used on a block with a sheave diameter of 72 mm are each designed to fail or disengage when subjected to a torsion load of more than 5 Nm (44 lb in). Therefore, when two such locking means are engaged, they will fail when the block is subjected to a torsion load of more than 10 Nm (88 lb in).

FIGS. 5*a* and 5*b* show a plan sectional view of the block shown in the other Figures. These Figures clearly show the bevelled nature of the head sections 55 of the locking means 50, and how this allows the swivel head 35 (and therefore the swivel attachment means 30) to rotate between the limits shown in FIGS. 5*a* and 5*b*. It is also possible that further locking means could be positioned on the other sides of the swivel head 35, either to change the degree of rotational restriction on the swivel head 35 when those locking means are engaged, or to increase the torsion load required before the locking means fail or disengage as described above.

FIG. 6 shows how the total load on a line passing through a block breaks down for various combinations of line diameter and sheave diameter. In this test, the "start load", i.e. the load on the line on the load side of the block (e.g. due to a sail) was fixed at 6.54 kg. This load is represented by the lower portion of each bar. The central portion of each bar represents the "bearing loss", i.e. the load due to rolling friction of the sheave and supporting bearings. The upper portion of each bar represents the "rope loss", i.e. the load due to the bending of the line around the arc of the sheave. The total load represented by each bar is the load required to pull a start load of 6.54 kg through the block system.

FIG. 6 shows the variation of the load contribution due to the bending of the line, and therefore of the total load, for 4 line diameters: 8 mm, 10 mm, 12 mm and 14 mm running on two different standard blocks made by the applicant: Size 1 and Size 2, which have sheave diameters of 51 mm and 66 mm respectively. It can be clearly seen that increasing the line diameter used on a given block increases the load due to the bending of the line, and as the ratio of sheave diameter to line diameter gets small (around 3:1), this contribution to the overall load can be up to 80%, significantly more than either the load on the line coming into the block system or the load due to rolling friction in the block system.

FIG. 7 shows the same data as described in relation to FIG. 6, but this time for a start load of 51.54 kg in each case. Increasing the start load results in an increase in the rolling friction load ("bearing loss"), and it can be seen that the proportion of the total load contributed by the bending of the line ("rope loss") is less significant, but still up to 45% of the total for sheave/line diameter ratios of about 3:1.

FIG. 8 plots the load due to the bending of the line as a percentage of the start load on the line for three common ropes used on sailing vessels: Liros, Marlowbraid and Dyneema, for a number of sheave to line diameter ratios from about 3:1 to about 7.5:1. The start load in each case was kept constant at 51.54 kg.

It can be clearly seen from the results in FIG. 8 that increasing the sheave to line diameter ratio reduces the contribution of line bending to the overall load, regardless of the line used. Extrapolation of this trend would suggest that the larger this ratio is made, the more the losses can be reduced. However, the reduction for ratios above around 6:1 is not so significant.

Other factors also affect the optimum choice of the sheave to line diameter ratio, since the line diameter is normally chosen with a consideration for the expected total load that the line is likely to bear (to prevent breaking), and so is usually fixed for a particular application (e.g. mainsheet, spinnaker halyard), whilst making larger and larger sheaves results in a similar increase in the size of the block as a whole. Larger blocks are not only heavier, but also impractical in many situations. Consequently, the preferred sheave to line diameter ratio which results in a practical block size and weight whilst reducing the load due to line bending to a less significant contribution to the overall load on the line is between 5:1 and 8:1, preferably between 5:1 and 7:1, and most preferably about 6:1.

What is claimed is:

1. A line-handling block with a body comprising first and second cheeks, the cheeks rotatably bearing a sheave for rotation about an axis; attachment means rotatably borne by said body; and at least one locking means engagable with the attachment means, which when engaged permits rotation of said attachment means relative to the cheeks and sheave between predetermined limits only.

2. A block according to claim 1 wherein the maximum rotation of the attachment means allowed either side of a central position, within the predetermined limits of rotation, is at least 2 degrees each side of the central position.

3. A block according to claim 2 wherein the maximum allowed deflection is at least 5 degrees each side of the central position.

4. A block according to claim 3 wherein the maximum allowed deflection is at least 10 degrees each side of the central position.

5. A block according to claim 1 wherein the maximum rotation of the attachment means allowed either side of a central position within the predetermined limits of rotation, is almost 90 degrees each side of the central position.

6. A block according to claim 5 wherein the maximum allowed deflection is at most 45 degrees each side of the central position.

7. A block according to claim 6 wherein the maximum allowed deflection is at most 30 degrees each side of the central position.

8. A block according to claim 1 wherein different limits of rotation to be imposed on the swivel attachment means by the locking means can be selected.

9. A block according to claim 8 wherein different one or ones of a plurality of locking means are selectively engageable and disengageable.

10. A block according to claim 1 wherein the axes of rotation of the sheave and of the swivel attachment means are orthogonal and coplanar.

11. A block according to claim 1 wherein the locking means are formed separately from the other components of the block and are removable therefrom.

12. A line-handling block with a body comprising first and second cheeks, the cheeks rotatably bearing a sheave for rotation about an axis; rotatable attachment means rotatably of said block; and at least one locking means engagable with the attachment means, which when engaged restricts the rotation of said attachment means in the block, the or each locking means being slidable in the body and movable from a first position, engaged in said body, in which it is engageable with the attachment means to a second position, also engaged in said body, in which it is disengaged from the attachment means.

13. A block according to claim 12 wherein the engagement of locking means with the body takes the form of a keyhole slot in which the locking means slides between the first position and the second position.

14. A block according to claim 13 wherein there is also a third position in which the locking means can be removed from the body.

15. A line-handling block with a body comprising first and second cheeks, the cheeks rotatably bearing a sheave for rotation about an axis; attachment means rotatably secured to said body; and at least one locking means engagable with the attachment means, which when engaged either prevents the rotation of said attachment means relative to the cheeks and sheave or only permits such rotation between predetermined limits, and which is adapted so as to disengage or to fail when a predetermined torsion load is exceeded, thereby allowing free rotation of said attachment means.

16. A block according to claim 15 wherein the predetermined torsion load is not more than 10 Nm for the entire block.

17. A block according to claim 16 wherein the predetermined load at which the locking means fails or disengages is adjustable.

18. A block according to claim 17 wherein a plurality of locking means are provided such that engaging or disengaging one or more of the plurality effects the said adjustment.

* * * * *